United States Patent [19]

Duerbeck et al.

[11] Patent Number: 4,470,156

[45] Date of Patent: Sep. 11, 1984

[54] TROUSERS FOR ATHLETIC WEAR AND OTHER USES

[76] Inventors: Guy K. Duerbeck; Jean S. Duerbeck, both of 1303 Harewood Square, Wexford, Pa. 15090

[21] Appl. No.: 545,442

[22] Filed: Oct. 26, 1983

[51] Int. Cl.[3] ..... A41D 1/08

[52] U.S. Cl. ..... 2/227

[58] Field of Search ..... 2/227, 238, 79, 80, 2/228

[56] References Cited

U.S. PATENT DOCUMENTS

| | | | |
|---|---|---|---|
| 198,299 | 12/1877 | Henning | 2/227 |
| 1,366,809 | 1/1921 | Kenrick | 2/227 |
| 1,654,452 | 12/1927 | Bradley | 2/227 |
| 1,827,585 | 10/1931 | Kautz | 2/227 |
| 2,283,362 | 5/1942 | Hamilton | 2/227 |
| 2,346,082 | 4/1944 | Riedl | 2/227 |
| 2,416,857 | 3/1947 | Trinkel | 2/227 X |
| 3,435,462 | 4/1969 | Bank | 2/227 |

FOREIGN PATENT DOCUMENTS

| | | | |
|---|---|---|---|
| 179529 | 9/1954 | Austria | 2/227 |
| 338166 | 6/1959 | Switzerland | 2/227 |

*Primary Examiner*—H. Hampton Hunter

*Attorney, Agent, or Firm*—Daniel J. Long

[57] ABSTRACT

A pair of trousers for athletic, casual or outdoor wear. These trousers are resistant to wear, but also have the flexibility and perspiration absorbency which are desirable in an athletic garment. A front section and seat section which are made from denim or some other durable fabric are fixed below a waist band section to cover a wearer's lower torso. A pair of leg sections made from sweat shirt fleece or some other suitable flexible material extends downwardly from these frontal and seat sections. Preferably, these leg sections will also be upwardly and frontally reinforced over the wearer's thigh with denim or some other durable material.

13 Claims, 4 Drawing Figures

TROUSERS FOR ATHLETIC WEAR AND OTHER USES

BACKGROUND OF THE INVENTION

1. Field of the Invention

The present invention relates to garments and, in particular, to trousers for athletic, casual or outdoor wear.

2. Description of the Prior Art

Various types of athletic garments are manufactured from a type of material known in the art as "sweat shirt fleece." This typically cotton, cotton and synthetic fiber blend or all synthetic fiber fabric has an absorbent, flocculent surface on its one side and a less absorbent, smooth surface on its other side. Conventionally, garments will be manufactured from this material so that the flocculent side is the inner surface of the garment and is adjacent the wearer's body so as to absorb perspiration therefrom.

A well known type of loose fitting, full length athletic trousers having both waist and ankle constrictive means is made from sweat shirt fleece material. Such trousers provide a high degree of flexibility and perspiration absorbency. Their ankle contrictive means also establish an insulating dead air space adjacent the wearer's legs as well as providing protection against drafts directed upwardly through the legs of these trousers. These trousers, however, have certain disadvantages including the fact that they often wear relatively quickly, particularly in their seat, crotch and frontal thigh and knee areas. It is, therefore, the object of the present invention to provide trousers for athletic and other uses having the flexibility, absorbency and warmth characteristics of the above described sweat shirt fleece trousers, but which are also resistant to wear and which have certain other advantages which are hereafter described.

SUMMARY OF THE INVENTION

The present invention is a pair of trousers adapted for athletic casual or outdoor wear in which a frontal section and a seat section depend downwardly from the waist and are connected to each other at their lateral sides to cover the lower part of the wearer's torso. The lower edges of the frontal and seat sections are also medially connected to cover the wearer's crotch and form adjoining leg apertures. These frontal and seat sections are made of a durable fabric such as denim. A pair of generally cylindrical leg sections made of sweat shirt fleece or some other flexible material are fixed to these frontal and seat sections and extend downwardly from each of the leg apertures. Preferably, the upper front parts of these leg sections will be reinforced with denim or some other durable material.

BRIEF DESCRIPTION OF THE DRAWINGS

The present invention is further described in the accompanying drawings in which.

DETAILED DESCRIPTION

Figure 1:
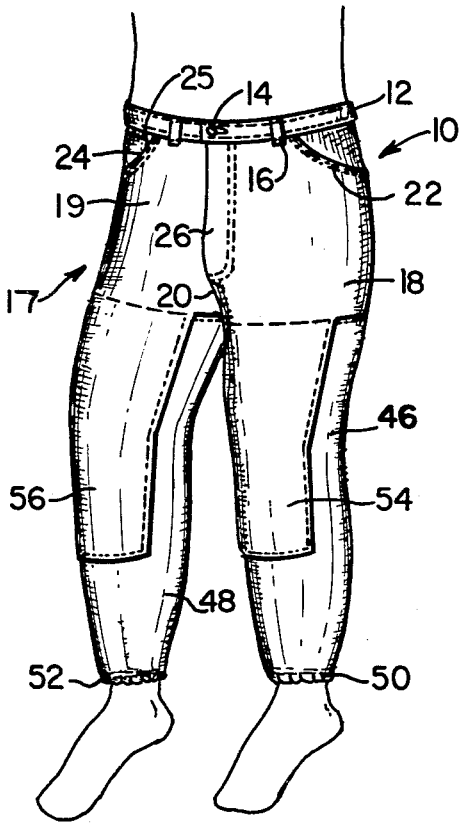
FIG. 1 is a perspective view of a pair of athletic trousers representing a preferred embodiment of the present invention.
Figure 2:
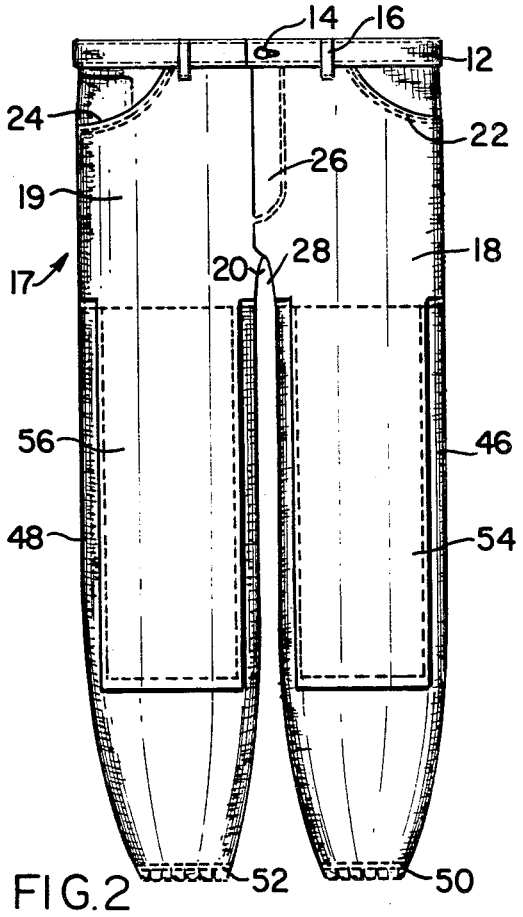
FIG. 2 is a front elevational view of a pair of athletic trousers representing a preferred embodiment of the present invention.

Referring to the drawings, the athletic trousers of the present invention are shown at numeral 10. This garment includes an elongated waist band 12, preferably made from denim or some other durable fabric, which is joinable at its terminal ends by means of fastener 14 to circumferentially cover the wearer's waist in the conventional manner. This waist band also is equipped with a plurality of belt loops as at 16 so that a belt (not shown) may be used with this garment. It will be appreciated that athletic garments heretofore known have often had to be equipped with elastic bands or with draw strings to provide the necessary constrictive means around the wearer's waist. Elastic can be disadvantageous since it may become deformed over the life of the garment. Draw strings may be disadvantageous in that they may become withdrawn within their casings when not tied, thus necessitating a laborous procedure of retrieving their terminal ends. Additionally, draw strings often become separated entirely from the garment during laundering.

A front section shown generally at numeral 17 is made up of two integral adjoining panels 18 and 19 and is made from denim or some other durable fabric and is also sewn to the lower edge of the waist band and extends downwardly from the waist band to a point below the crotch 20.

This frontal section will cover the lower front section of the wearer's torso. It is preferably also equipped with pockets 22 and 24 as well as coin pocket 25 and zipper cover 26 which covers a zipper (not shown) that, when engaged, connects panels 18 and 19. Preferably, the above described pockets will be sufficiently deep that they will provide secure storage for articles carried by persons engaged in even highly mobile athletic endeavors. It will be appreciated that pockets providing such secure storage are usually not found in the athletic trousers heretofore known. On its lower edge the frontal section also has a medial recess 28.

Figure 3:
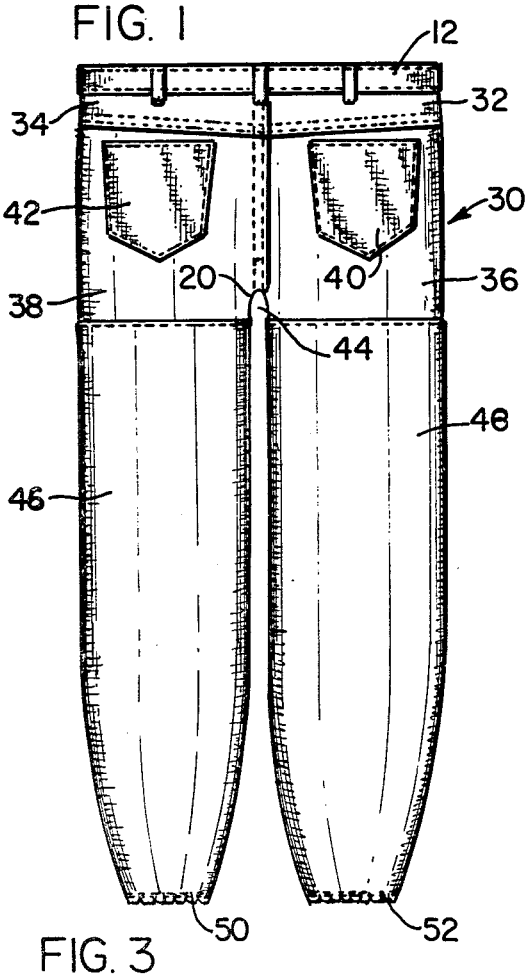
FIG. 3 is a rear elevational view of the trousers shown in FIG. 2.
Figure 4:
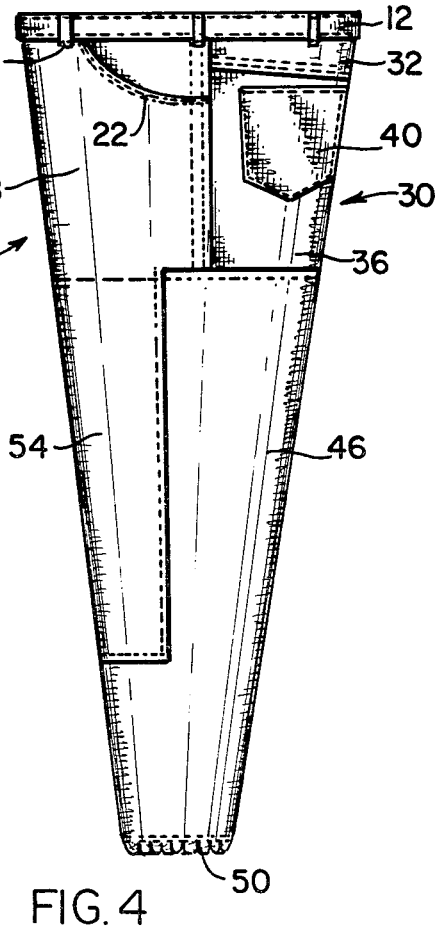
FIG. 4 is a side elevational view of the trousers shown in FIG. 2.

A seat section shown generally at numeral 30 also extends downwardly from the lower edge of the waist band to a point below the crotch and it is also made of a durable material such as denim or the like. From FIG. 3 it will be seen that it is made up of four integral panels 32, 34, 36 and 38 and that it is also equipped with two pockets 40 and 42. It will also be observed that the lateral edges of the seat section are each attached to a lateral edge on the frontal section. On the lower edge of the seat section there is also a medial recess 44 and the edges of this recess are sewn to the edges of recess 28 on the frontal section so as to form a covering for the wearer's crotch and two adjacent apertures through which the wearer's legs will pass.

At these apertures a first and second generally cylindrical leg covering sections 46 and 48, respectively, are sewn to the frontal and seat sections and extend downwardly therefrom. These leg sections are made from sweat shirt fleece or some other suitably flexible and preferably absorbent material. It would, for example, also be possible to manufacture these leg sections from a woolen material either in a form of a knit or in a form analogous to sweat shirt fleece with an interior floculent side and an exterior smooth side. Preferably elastic bands 50 and 52 or some other constructive means such as zippers, snaps or VELCRO attachments will be positioned at the lower terminal end of these leg covering sections. It is also preferred that reinforcing panels 54 and 56 made of denim or some other durable material be sewn over the upper front portions of the leg covering sections. Preferably, these reinforcing sections will extend downwardly far enough to cover the wearer's knees when he is either in a standing or kneeling position. Alternatively, it would also be possible, and be within the scope of the present invention, to include these reinforcing panels as integral, downwardly projecting apendages of the frontal section 17.

It will be appreciated that there has been described a pair of athletic trousers which provide the wearer with a high degree of comfort, flexibility, warmth and absorbency for perspiration but which also resist wear in the seat, crotch and in the upper leg sections. Although the invention has been described with some degree of particularity, it will be understood that the invention is defined by what is hereafter claimed.

What is claimed is:

1. A trouser garment comprising:

(a) an elongated waist band section having upper and lower edges and terminal ends joinable with each other to circumferentially cover a wearer's waist;

(b) a frontal section consisting of a durable fabric having an upper edge, a pair of opposed lateral edges and a lower edge, said frontal section being fixed to the lower edge of the waist band section and extending downwardly therefrom to a point below the wearer's crotch so as to cover the lower front portion of the wearer's torso;

(c) a seat section consisting of a durable fabric and having an upper edge, a pair of opposed lateral edges, said seat section being fixed to the lower edge of the waist band section and extending downwardly therefrom to cover the wearer's buttocks and being fixed at each of its lateral edges to one of the lateral edges of the front section and also being medially secured at its lower edge to a medial portion of the lower edge of the frontal section so as to cover the wearer's crotch and form opposed first and second leg apertures between said frontal and seat section;

(d) first and second generally cylindrical leg sections, each of said leg sections consisting of a flexible sweat shirt fleece type fabric and having upper and lower edges and said first leg section connected to the frontal and rear sections adjacent the first leg aperture and extending downwardly therefrom to cover one of the wearer's legs and the second leg section connected to the frontal and rear sections adjacent the second leg aperture and extending downwardly therefrom to cover the other of the wearer's legs; and (e) an upper, frontal durable fabric reinforcement means positioned over each of the leg sections and extending downwardly to approximately the wearer's knees.

2. The garment as defined in claim 1 wherein the waist band section consists of a durable fabric.

3. The garment as defined in claim 1 wherein the frontal section is equipped with one or more pockets.

4. The garment as defined in claim 1 wherein the frontal section consists of denim.

5. The garment as defined in claim 1 wherein the seat section is equipped with one or more pockets.

6. The garment as defined in claim 1 wherein the seat section consists of denim.

7. The garment as defined in claim 1 wherein the frontal section and the seat section both have lower medial recesses and wherein said medial securement between the frontal section and the seat section is along the edge of said recesses.

8. The garment as defined in claim 1 wherein the leg sections both have constrictive means at their lower edges.

9. The garment as defined in claim 1 wherein the waist band is equipped with belt loops.

10. The garment as defined in claim 8 wherein the restrictive means are elastic.

11. The garment as defined in claim 1 wherein the upper, frontal durable fabric reinforcement means consist of denim.

12. The garment as defined in claim 1 wherein the upper frontal durable reinforcement means extend downwardly to cover the wearer's knees.

13. The garment as defined in claim 1 wherein the upper frontal durable reinforcement means are integral with the frontal section.

* * * * *